US006046408A

United States Patent [19]

Forrest

[11] Patent Number: 6,046,408

[45] Date of Patent: Apr. 4, 2000

[54] NEUTRAL CONDUCTOR GROUNDING SYSTEM

[75] Inventor: Ian W. Forrest, Columbia, S.C.

[73] Assignee: Hendrix Wire & Cable, Inc., Milford, N.H.

[21] Appl. No.: 09/105,825

[22] Filed: Jun. 26, 1998

Related U.S. Application Data

[62] Division of application No. 08/732,152, Oct. 16, 1996.

[51] Int. Cl.[7] ..... H01B 7/18

[52] U.S. Cl. ..... 174/106 R; 174/106 SC

[58] Field of Search ..... 174/102 R, 106 SC, 174/102 SC, 105 SC, 120 R, 120 SC, 106 R

[56] References Cited

U.S. PATENT DOCUMENTS

| | | | |
|---|---|---|---|
| 2,437,708 | 3/1948 | Plass et al. | 174/102 |
| 3,474,189 | 10/1969 | Plate et al. | 174/115 |
| 3,571,613 | 3/1971 | Plate | 307/147 |
| 3,660,592 | 5/1972 | Anderson | 174/114 R |
| 3,728,474 | 4/1973 | Arnaudin, Jr. | 174/115 |
| 3,735,025 | 5/1973 | Ling et al. | 174/120 SC |
| 4,025,715 | 5/1977 | Foley et al. | 174/36 |
| 4,109,098 | 8/1978 | Olsson et al. | 174/106 SC |
| 4,687,882 | 8/1987 | Stone et al. | 174/102 SC |
| 4,767,894 | 8/1988 | Schombourg | 174/106 |
| 4,853,565 | 8/1989 | Elton et al. | 310/45 |
| 4,986,372 | 1/1991 | Gansle | 174/106 |
| 5,028,742 | 7/1991 | Redman | 174/88 |
| 5,036,165 | 7/1991 | Elton et al. | 174/102 SC |
| 5,066,881 | 11/1991 | Elton et al. | 310/213 |

*Primary Examiner*—Kristine Kincaid
*Assistant Examiner*—William H. Mayo, III
*Attorney, Agent, or Firm*—Piper Marbury Rudnick & Wolfe

[57] ABSTRACT

System neutral to earth grounding, over the entire length of an electrical cable is achieved by adding one or more strips of semi-conductive material over the helically or otherwise wound concentric neutral conductors and completing the cable jacket with insulating material. The strip engages the soil when buried to provide a continuous ground path for the neutral conductors. In a second form protrusions of semi-conductive material project from a semi-conductive layer and encircle certain ports of the neutral conductors while the remainder are partially surrounded by the semi-conductive layer. Insulating material segments complete the cable jacket. The free ends of the protrusions engage the soil about the cable to provide a continuous ground for the neutral conductors helically wound or extending in parallel with the cable longitudinal axis.

6 Claims, 3 Drawing Sheets

NEUTRAL CONDUCTOR GROUNDING SYSTEM

This application is a division of application Ser. No. 08/732,152 filed Oct. 16, 1996, which was patented.

BACKGROUND OF THE INVENTION

1. Field of the Invention

This invention is directed to the field of medium and high voltage cables and more particularly to the grounding of the concentric neutral conductors of such cables.

2. Description of the Prior Art

The concentric neutral conductors of medium to high voltage cables are formed as wire or tape braids wrapped about the semi-conductive insulation shield of such cable. The neutral conductors are intended to provide a return circuit for load currents and to maintain the shield at ground potential to prevent injury to persons coming in contact with the cable.

Since the concentric neutral conductors are on the outside of the cable and the cable is intended to be buried in the ground, the concentric neutral conductors are attacked and destroyed by ground water, hostile elements in the environment of the cable, such as polluted ground water, corrosive acids, bases and other chemical substances present The destruction of the concentric neutral conductors thus removes the return path for the load, fault and charging currents and could cause increasing voltage potentials on the shield.

To prevent destruction of the concentric neutral conductors, an insulating or a semi-conductive jacket can be placed over the cable as well as the concentric neutral conductors. This semi-conductive jacket is relatively expensive. The requirement that the concentric neutral conductors be grounded at regular intervals is met by the semi-conductive jacket, but with the insulating jacket it is required that the cable jacket be removed and the concentric neutral conductors be to a ground point. The cable must be sealed at the interruption of the cable jacket and the ground wires protected. This is a slow and expensive process.

SUMMARY OF THE INVENTION

The present invention overcomes the difficulties noted above with respect to prior art medium to high voltage cable concentric neutral conductor grounding systems by providing a cable with continuous outer jacket made up of one or more semi-conductive elements coupled to the concentric neutral conductors and insulation material therebetween. The cable can be directly buried and semi-conductive elements engage the surrounding earth to establish a solid ground for the concentric neutral conductors. Because the outer jacket is continuous, any water or environmental contaminants present can not reach the concentric neutral conductors and cause their destruction. Further, because the semi-conductive elements extend to the cable outer surface, it is not necessary to interrupt the cable jacket and repair same after the ground wire is connected to the concentric neutral conductors.

In a first embodiment, a semi-conductive strip in an otherwise insulating jacket is provided along the entire cable length. This strip or extension will engage each of the helically wound concentric neutral conductors at substantially regular intervals. The cable jacket is completed using insulating material placed about the insulation shield and engaging the side walls of the strip or extension providing a continuous jacket of uniform thickness. If desired a number of parallel strips or extensions could be employed.

A second embodiment employs a semi-conductive layer about the insulation shield with protrusions extending from the semi-conductive layer and about selected ones of the concentric neutral conductors. The cable jacket is completed using insulating material placed about the insulation shield and engaging the side walls of the protrusions. The non-selected concentric neutral conductors are partially embedded in the semi-conductive layer and are enclosed by the insulating jacket. The concentric neutral conductors can be helically or otherwise wound about the insulation shield or positioned parallel with the longitudinal axis of the cable. It is an object of this invention to provide an electrical cable with improved means to ground the concentric neutral conductors of such cable.

It is an object of this invention to provide an electrical cable having a continuous, uniform jacket, a portion of which is formed of semi-conductive material.

It is still another object of this invention to provide an electrical cable having at least one strip of semi-conductive material coupled to the neutral conductors of said cable jacket to ground the concentric neutral conductors when said cable is buried.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
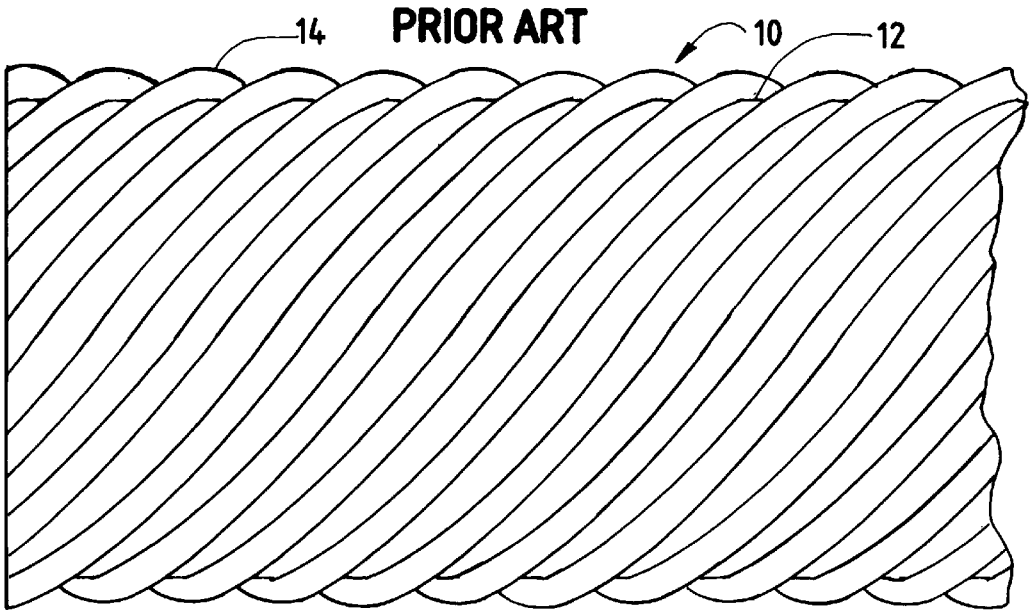
FIG. 1 PRIOR ART
FIG. 1 is a fragmentary side elevational view of a prior art electrical cable having exposed helically wound concentric neutral conductors.
Figure 2:
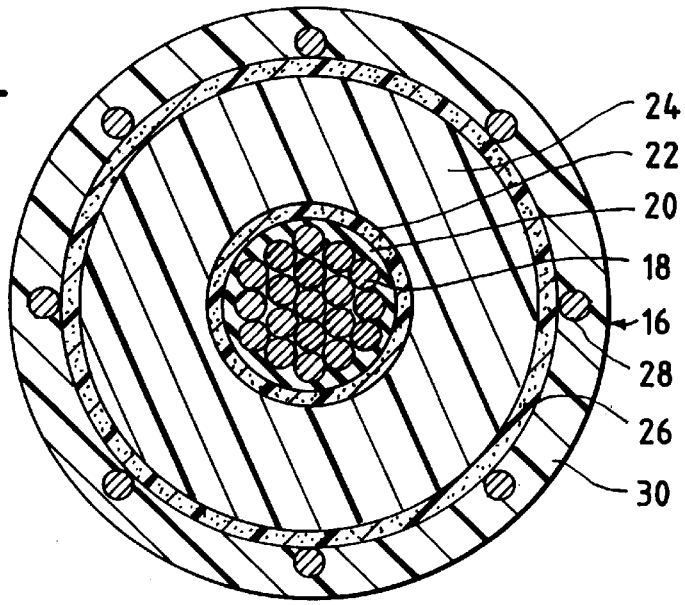
FIG. 2 PRIOR ART
FIG. 2 is a front elevational view, in section, of a prior art electrical cable similar to that shown in FIG. 1 but with a jacket about the helically wound concentric neutral conductors.
Figure 3:
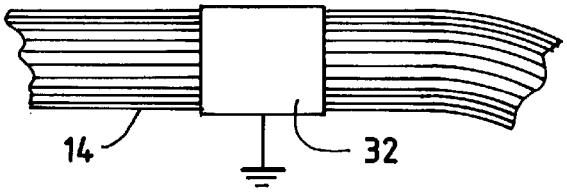
FIG. 3 PRIOR ART
FIG. 3 is a fragmentary side elevational view of the gathered and grounded concentric neutral conductors of the prior art electrical cable of FIG. 1.

Turning now to FIGS. 1, 2 and 3, there is shown electrical cables 10 and 16 according to the prior art. Cable 10 has a semi-conductive insulation shield 12 as its exposed outer layer and has a braid of neutral concentric conductors 14 wrapped in a helical fashion about the exterior of the semi-conductive insulation shield 12. The semi-conductive insulation shield 12 may be fabricated from natural or synthetic rubber, plastics or other materials to which a conductive material has been added. One material commonly used is ethylene propylene diene terpolymer or EPDM to which carbon black has been added to make the EPDM semiconductive. Wrapped about the exterior of the shield 12 is a helically wound braid of concentric neutral conductors 14 which provide a return circuit for load currents and maintains the shield 12 at ground potential to prevent injury to persons coming in contact with the cable 10. The concentric neutral conductors are made of copper or copper alloys and may have a protective coating thereon. The engagement of the concentric neutral conductors with the bare soil about the cable 10 provides the necessary grounding for the concentric neutral conductors 14. A further ground connection can be achieved as is shown in FIG. 3 by bringing the concentric neutral conductors 14 together at a clamp 32 and tying the clamp 32 to a grounding rod or screen or other devices (not shown).

In that the cable 10 is directly buried in the soil as by digging a trench, placing the cable 10 in such trench (not shown) and backfilling the trench, it is subject to all of the contaminants present in the ground, ground water alone or ground water polluted with acids, bases, oils and other chemical substances. As a result of the action of the substances present in the soil, the concentric neutral conductors 14 may be corroded and thus unable to perform their desired function.

FIG. 2 shows an approach taken by the prior art wherein the concentric neutral conductors 28 are embedded in an insulating jacket 30. Electrical cable 16 has a plurality of individual conductors or strands 18 about which a semi-conductive shield layer 22 is placed. The interstices between the strands 18 and the shield layer 22 are filled with a conductor strand fill 20 which may be insulating EPDM. About the shield layer 22 is placed the insulation layer 24 which may also be insulating EPDM. The EPDM rubber is insulating in its manufactured state and is made semi-conductive by the addition of highly conductive carbon black or similar additives. Surrounding the insulating layer 24 is an insulating shield layer 26 of semi-conductive EPDM. Helically or otherwise wound about the exterior surface of shield layer 26 is a braid of helically wound concentric neutral conductors 28. An insulating jacket 30 is placed about the insulation shield layer 26 and encompasses the concentric neutral conductors 28.

To ground the neutral conductors 28, the insulating jacket 30 must be removed from cable 16, the concentric neutral conductors 28 gathered together, as by clamp 32 and coupled to a solid ground. The exposed insulation shield layer 26, the exposed neutral conductors 28 and the clamp 32 must be protected from the cable environment once it is buried. Failure to properly seal the ground joint could lead to, at least, the destruction of the concentric neutral conductors 28.

Figure 4:
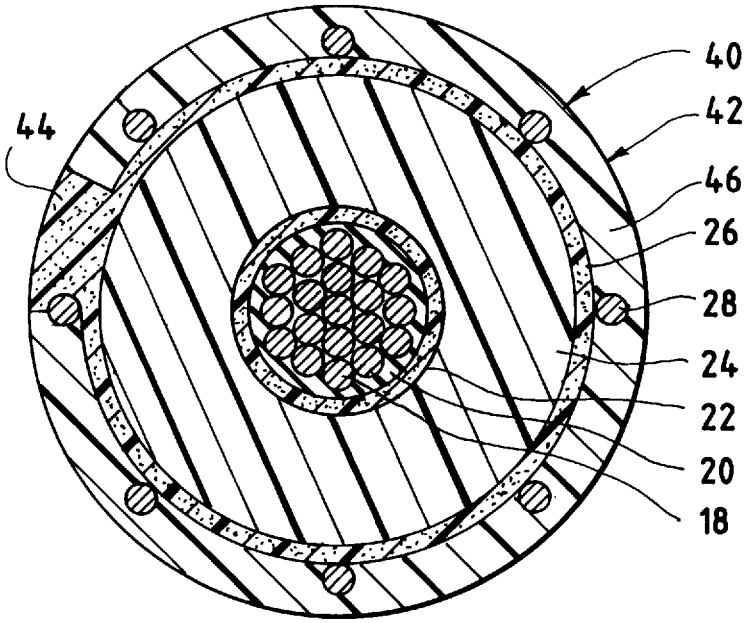
FIG. 4 is a front elevational view, in section, of a first embodiment of an electrical cable constructed in accordance with the concepts of the invention.
Figure 5:
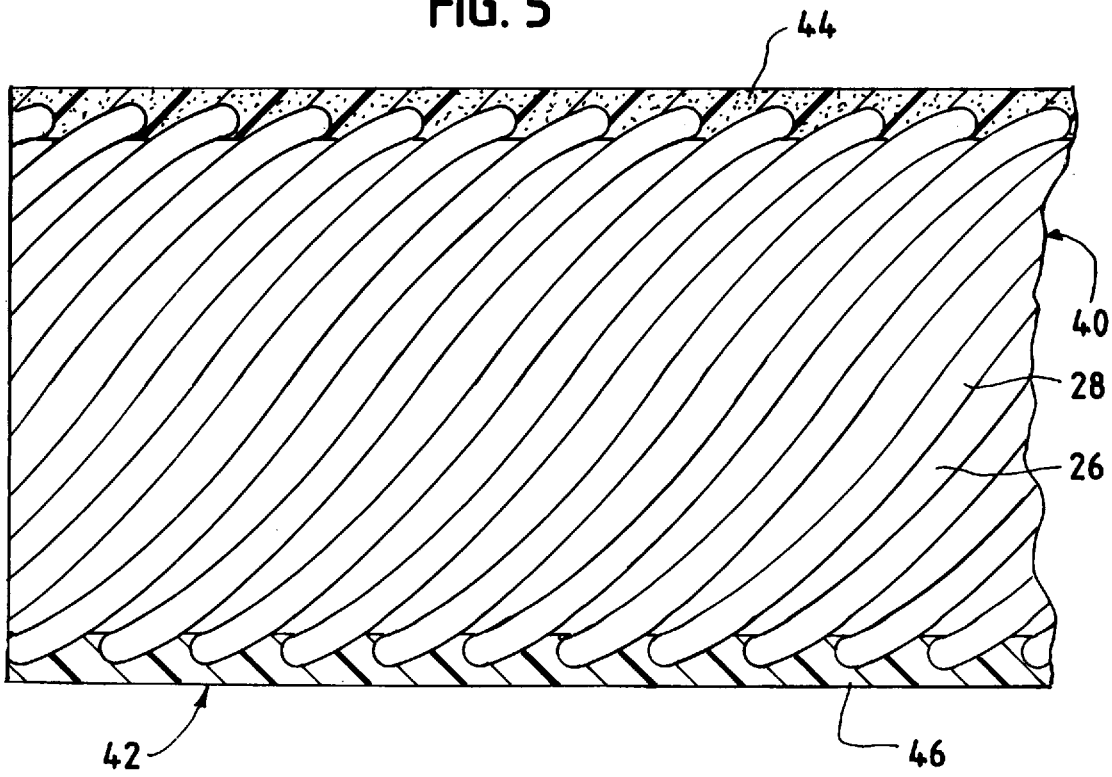
FIG. 5 is a fragmentary side elevational view, partly in section, of the electrical cable of FIG. 4 showing the manner in which the semi-conductive strip or extension engages each of the concentric neutral conductors.

Turning to FIGS. 4 and 5 there is shown a first embodiment of a concentric neutral conductor grounding system constructed in accordance with the concepts of the invention. Electrical cable 40 has a central conductor made up of plurality of individual strands 18 about which a semi-conductive shield layer 22 is placed. The interstices between the strands 18 and the shield layer 22 are filled with a conductor strand fill 20. About shield layer 22 is placed insulating layer 24. A semi-conductive insulation shield layer 26 is formed about insulation layer 24 and the concentric neutral conductors 28 are helically wound about the exterior of the shield layer 26. A strip 44 of semi-conductive material is now formed along the entire length of cable 40. This strip 44 will engage each of the concentric neutral conductors 14 in turn at regular intervals as is shown in FIG. 5. The outer jacket 42 is now completed by placing insulating material 46 about the remainder of insulation shield 26. The thickness of layer 46 will be the same as that of strip 44 and the layer 46 and strip 44 can be vulcanized or bonded to one another to form a continuous uniform outer jacket 42. The strip 44 can be vulcanized to shield 26 or bonded to it. The jacket 42 can be formed by molding or by extruding the strip 44 and the insulation 46 at the same time or separately extruding the strip 44 and insulation 46 and then joining them by vulcanization or bonding. Although only a single strip 44 is shown more strips may be employed and the size of the strip 44 varied according to the needs of the particular cable.

When buried, the strip 44 provides a direct ground contact for each of the concentric neutral conductors 28. The concentric neutral conductors 28 are not exposed to the environmental elements that destroy bare, exposed concentric neutral conductors and the cable jacket does not have to be breached at regular intervals to permit the concentric neutral conductors to be coupled to ground. Instead a continuous ground connection is established for the concentric neutral conductors all along the cable length while preserving the integrity of the cable jacket;.

Figure 6:
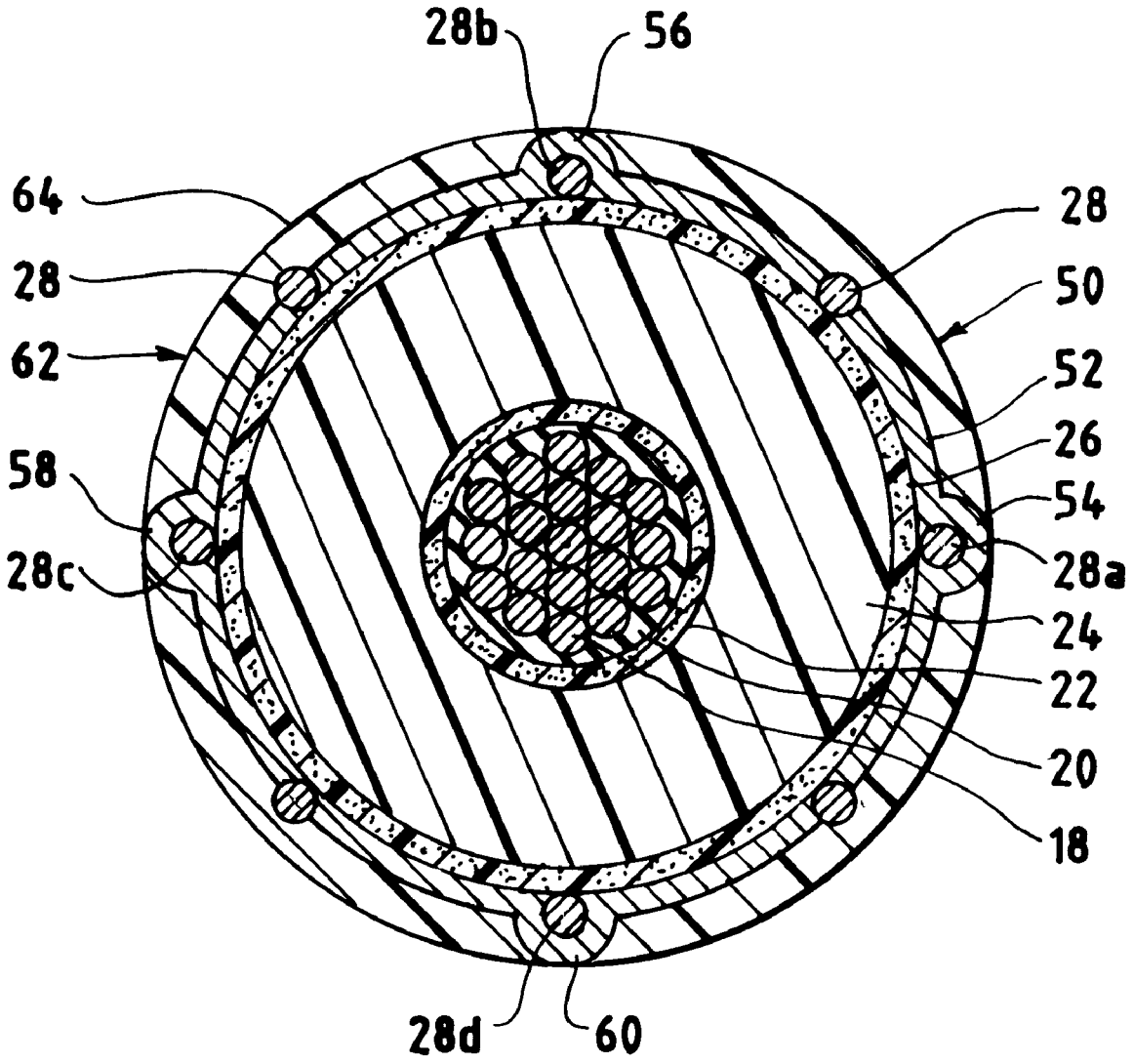
FIG. 6 is a front elevational view, in section, of a second embodiment of an electrical cable constructed in accordance with the concepts of the invention.

An alternative construction as shown in FIG. 6. Cable 50 has strands 18, conductor shield 22 with conductor strand fill 20 within, an insulation layer 24 and an insulation shield layer 26 as do cables 16 and 40 described above. A braid of concentric neutral conductors 28 is placed about shield layer 26. About the shield layer 26 and certain of the concentric neutral conductors 28 a further semi-conductive layer 52 is deposited. The layer 52, at least, partially surrounds each of the concentric neutral conductors 28. A series of protrusions 54, 56, 58 and 60, also of semi-conductive material, complete the enclosure of concentric neutral conductors 28*a*, 28*b*, 28*c* and 28*d*, respectively. The jacket 62 of electrical cable 50 is completed by placing insulation segments 64 on the outer surface of layer 52 and between the protrusions 54, 56, 58 and 60. Although the number of protrusions are less than the total number of concentric neutral conductors 28, fewer or more protrusions may be employed and the protrusions may be used about the concentric neutral conductors 28 in other patterns than the alternating pattern shown. This approach may also be employed with cables having concentric neutral conductors that extend parallel with the longitudinal axis of the cable and are not helically wound about the insulation shield layer.

The semi-conductive layer 52 and protrusions 54, 56, 58 and 60 may be extruded over insulation shield layer 26 and then the insulation segments 64 extruded over layer 52 between the protrusions 54, 56, 58 and 60 and vulcanized or bonded to the layer 52 and the protrusions 54, 56, 58 and 60. The insulation segments 64 and the layer 52 and protrusions 54, 56, 68 and 60 can also be extruded at one time or the parts can be molded and later bonded or vulcanized to join the various components. The outer surface of each of the protrusions 54, 56, 68 and 60 provide the direct grounding contact for the concentric neutral conductors 28*a*, 28*b*, 28*c* and 28*d* respectively while the remainder of layer 52 provides grounding for the remaining concentric neutral conductors 28.

While there has been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

I claim:

1. An electrical cable having an outer surface and for buried in-ground use, comprising:

a) a concentrically arranged central conductor;

b) conductor insulation;

c) insulation shield;

d) a plurality of helically or otherwise wound neutral conductors;

e) at least one semi-conductive extension extending in a direction perpendicular to the central longitudinal axis of said electrical cable and away from said central conductor, said at least one semi-conductive extension having a first end engaging said insulation shield and a second free end and a body portion having side walls therebetween engaging said neutral conductors; and f) an insulating jacket placed about said insulation shield and engaging said side walls of said body portion and having a thickness equal to the height of said free end of said at least one semi-conductive extension above said insulation shield, the outer surface of said insulating jacket and said free end of said at least one semi-conductive extension form a continuous outer surface whereby said neutral conductors buried in-ground are grounded over the length of said electrical cable.

2. An electrical cable as defined in claim 1, wherein said at least one semi-conductive extension is one semi-conductive extension and said one semi-conductive extension is formed in continuity with said insulation shield.

3. An electrical cable as defined in claim 2, wherein said body portion engages each of said plurality of helically or otherwise wound neutral conductors at a different location along the length of said electrical cable.

4. An electrical cable as defined in claim 1, wherein said at least one semi-conductive extension at least partially encloses each of said plurality of neutral conductors.

5. An electrical cable as defined in claim 1, further comprising:

a) a neutral conductor shield layer about said insulation shield at least partially enclosing each of said plurality of neutral conductors;

b) a further plurality of semi-conductive extensions, said further plurality being less than said plurality of neutral conductors, each of said further plurality of semi-conductive extensions having a first end engaging said neutral conductor shield layer and a second free end and a body portion having side walls therebetween for enveloping a different one of said neutral conductors whereby one or more of said plurality of neutral conductors are enveloped by said body portion of said further plurality of semi-conductive extensions and the other of said plurality of neutral conductors are partially enclosed by said neutral conductor shield layer; and c) said insulating jacket extends between said side walls of said body portions of said further plurality of semi-conductive extensions and over said neutral conductor shield layer and said neutral conductors not enveloped by said body portions of said further plurality of semi-conductive extensions.

6. An electrical cable as defined in claim 5, wherein said one or more of said plurality of neutral conductors enveloped by said body portions of said further plurality of semi-conductive extensions alternate with said at least partially enclosed neutral conductors.

* * * * *